US006183344B1

(12) United States Patent
Tsuchimoto et al.

(10) Patent No.: US 6,183,344 B1
(45) Date of Patent: Feb. 6, 2001

(54) METHOD FOR GRINDING GLASS FUNNEL SEAL EDGE AND APPARATUS THEREFOR

(75) Inventors: Yoshihiro Tsuchimoto; Shinji Tanaka; Shigeru Muramoto, all of Chiba (JP)

(73) Assignee: Asahi Glass Company Ltd., Tokyo (JP)

( * ) Notice: Under 35 U.S.C. 154(b), the term of this patent shall be extended for 0 days.

(21) Appl. No.: 09/454,529

(22) Filed: Dec. 6, 1999

(30) Foreign Application Priority Data

Dec. 7, 1998 (JP) ..... 10-347536

(51) Int. Cl.[7] ..... B24B 49/00; B24B 51/00

(52) U.S. Cl. ..... 451/5; 451/41; 451/43; 451/11

(58) Field of Search ..... 451/5, 8, 9, 10, 451/11, 23, 24, 14, 41, 42, 43, 44, 288, 259, 262, 270, 271, 268, 269

(56) References Cited

U.S. PATENT DOCUMENTS 4,718,203 * 1/1988 Schweitz et al. ..... 451/44
4,982,531 * 1/1991 Biebuyck ..... 451/44
5,044,122 * 9/1991 Ratcliff ..... 451/44
5,409,417 * 4/1995 Bando ..... 451/44

FOREIGN PATENT DOCUMENTS 3-184755 * 8/1991 (JP) .
10-34505 * 2/1998 (JP) .

* cited by examiner

*Primary Examiner*—Derris H. Banks
(74) *Attorney, Agent, or Firm*—Oblon, Spivak, McClelland, Maier & Neustadt, P.C.

(57) ABSTRACT

A seal edge grinding method for a glass funnel, wherein a glass funnel seal edge and a grinding wheel are pressed against each other, and the seal edge is ground with the grinding wheel, comprising: moving a glass funnel and a grinding wheel by a certain quantity in an relatively approaching direction by a mobile unit under numerical control to grind a seal edge of the glass funnel with the grinding wheel by the use of feed controlled grinding; and relatively pressing the seal edge and the grinding wheel at a certain pressure by a pressing force of a pressing unit to grind the seal edge with the grinding wheel by the use of pressure controlled grinding after completion of the feed controlled grinding.

4 Claims, 2 Drawing Sheets

METHOD FOR GRINDING GLASS FUNNEL SEAL EDGE AND APPARATUS THEREFOR

BACKGROUND OF THE INVENTION

1. Field of the Invention

The present invention relates to a method for grinding the seal edge of a glass funnel and an apparatus therefor, in particular grinding method and apparatus for grinding the seal edge of a glass funnel for a cathode-ray tube.

2. Discussion of Background

Glass funnels, which form a cathode-ray tube for a TV set, a display and other devices, have a seal edge thereof ground by a grinding apparatus before having been assembled into the Cathode-ray tube since the seal edge is required to have proper surface roughness and good flatness.

An example of such a grinding apparatus, there is the grinding apparatus disclosed in JP-A-1034505, wherein a glass funnel is rotated with the seal edge thereof directed downward, and rotating grinding wheels are pressed against the seal edge to grind the seal edge. This grinding apparatus presses the grinding wheels against the seal edge by a weight to grind the seal edge at a constant pressure in order to improve the grinding precision of the seal edge.

On the other hand, the grinding apparatus disclosed in JP-B-533114 presses the seal edge of the glass funnel against grinding wheels by a weight to grind the seal edge at a constant pressure. This grinding apparatus includes a device for stopping the downward movement of the glass funnel when the glass funnel has lowered to a location corresponding to a set grinding removal.

However, the grinding apparatuses disclosed in JP-A-1034505 and JP-B-0533114 have created a problem in that it is impossible to improve grinding efficiency since the apparatuses grind the seal edge at a constant pressure all the time.

This problem may be eliminated by making the weight load heavier to increase the level of the constant pressure. However, if the pressure is increased too much, the flatness of a ground surface has been deteriorated because of variations in the behavior of the grinding wheels, and a defect, such as a chip, has been caused at the seal edge in some cases.

SUMMARY OF THE INVENTION

The present invention is proposed in consideration of the circumstances. It is an object of the present invention to provide a method for grinding the seal edge of a glass funnel and an apparatus therefor capable of grinding the seal edge in better and more effective fashion.

In order to achieve the object, the present invention provides a seal edge grinding method for a glass funnel, wherein a glass funnel seal edge and a grinding wheel are pressed against each other, and the seal edge is ground with the grinding wheel, comprising moving a glass funnel and a grinding wheel by a certain quantity in an relatively approaching direction by a mobile unit under numerical control to grind a seal edge of the glass funnel with the grinding wheel by the use of feed controlled grinding; and relatively pressing the seal edge and the grinding wheel at a certain pressure by a pressing force of a pressing unit to grind the seal edge with the grinding wheel by the use of pressure controlled grinding after completion of the feed controlled grinding.

In order to achieve the object, the present invention also provides a seal edge grinding apparatus for a glass funnel, wherein a glass funnel has a seal edge ground, comprising a supporting member for supporting a glass funnel at a yoke portion thereof; a grinding wheel for grinding a seal edge of the glass funnel; a mobile unit for moving the supporting member and the grinding wheel in a relatively approaching direction by a certain quantity; a controller for numerically controlling relative displacement of the supporting member and the grinding wheel by the mobile unit; and a pressing unit for pressing at least one of the supporting member and the grinding wheel at a certain pressure by a pressing force; wherein the seal edge of the glass funnel is ground by the use of pressure controlled grinding by the pressing unit after the seal edge has been ground with the grinding wheel by the use of feed controlled grinding, being numerically controlled.

In order to achieve the object, the present invention also provides a seal edge grinding apparatus for a glass funnel, wherein a glass funnel has a seal edge ground, comprising a supporting member for supporting a glass funnel from upwardly and pressing the glass funnel with the glass funnel having a seal edge directed downwardly; an elevating member for vertically moving the supporting member; a grinding wheel provided under the supporting member; a pressing unit for pressing the supporting member toward the grinding wheel at a certain pressure; a mobile unit for moving the supporting member by a certain quantity with respect to the grinding wheel; and a controller for numerically controlling vertical displacement of the supporting member by the mobile unit.

In the grinding method according to the present invention, the seal edge of a glass funnel and the grinding wheel are first contacted each other. Next, the glass funnel and the grinding wheel are moved by a certain quantity in the relatively approaching direction by the mobile unit under numerical control to grind the seal edge with the grinding wheel by the use of feed controlled grinding. Then, the seal edge and the grinding wheel are relatively pressed at a certain pressure by the pressing force of the pressing unit to grind the seal edge with the grinding wheel by the use of pressure controlled grinding after completion of the feed controlled grinding. In this case, the grinding removal in the feed controlled grinding may be preset, or be set whenever the seal edge is ground.

In other words, in accordance with the present invention, a large part of a set finishing allowance is removed by the use of the feed controlled grinding, and the remaining part of the finishing allowance, which is smaller, is removed by the use of the pressure controlled grinding. By combining the feed controlled grinding and the pressure controlled grinding in such fashion, the grinding removal per a unit time can be increased in comparison with the grinding removal only by the pressure controlled grinding to improve grinding efficiency. The pressure controlled grinding can be finally carried out to remove a deficiency of the seal edge caused during the feed controlled grinding, such as incorrect flatness and a chip, so as to make the seal edge better.

In accordance with the grinding apparatus of the present invention, the supporting member, which supports a glass funnel, or the grinding wheel is first moved in the relatively approaching direction by the mobile unit to contact the glass funnel seal edge and the grinding wheel each other. Next, the move of the glass funnel and the grinding wheel in the approaching direction can be continued by the mobile unit to grind the seal edge with the grinding wheel by the use of the feed controlled grinding. At that time, the grinding removal by the use of the feed controlled grinding can be finely controlled since the controller numerically controls the displacement by the mobile unit. Then, the seal edge and the grinding wheel are relatively pressed at a certain pressure by the pressing force of the pressing unit, and the seal edge of the glass funnel is ground with the grinding wheel by the use of the pressure controlled grinding after the seal edge has been ground with the grinding wheel by the use of the feed controlled grinding.

Thus, the seal edge can be ground in better and more efficient fashion.

In accordance with the present invention, a glass funnel is first supported by the supporting member provided on the elevating member, and the elevating member is lowered toward the grinding wheel by the mobile unit to press a seal edge of the glass funnel against the grinding wheel. Next, the downward move of the glass funnel can be continued by the mobile unit to grind the seal edge with the grinding wheel by the use of the feed controlled grinding. At that time, the controller numerically controls the displacement of the elevating member by the mobile unit. Then, the seal edge is pressed against the grinding wheel at a certain pressure by the pressing force of the pressing unit provided on the elevating member, and the seal edge is ground with the grinding wheel by the use of the pressure controlled grinding after completion of the feed controlled grinding.

When the supporting member is vertically moved through a pole, the mobile unit for the supporting member can be provided independently from the pole to reduce the weight load of the pole by the weight of the mobile unit, and there is no need to prepare the pole and the supporting member so sturdily to cope with production requirements.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Now, the method and apparatus for grinding the seal edge of a glass funnel according to an embodiment of the present invention will be described in detail, referring to the accompanying drawings.

Figure 1:
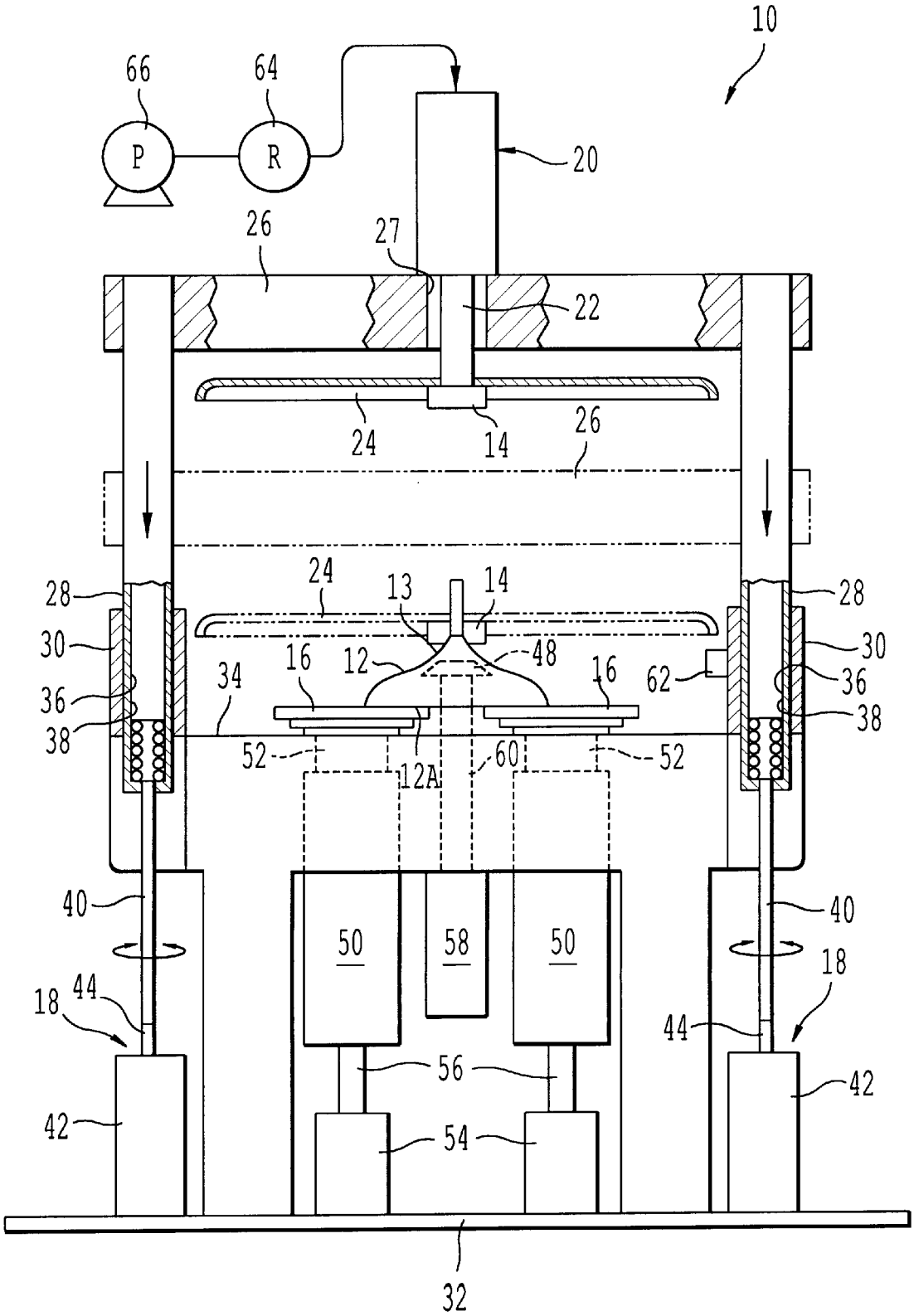
FIG. 1 is a front view of the apparatus for grinding the seal edge of a glass funnel according to an embodiment of the present invention.

In FIG. 1 is shown a front view of the apparatus 10 for grinding the seal edge of a glass funnel for a Cathode-ray tube according to the embodiment. The shown apparatus 10 mainly comprises a yoke supporting ring (corresponding to a supporting member) 14 for supporting a glass funnel 12, grinding wheels (corresponding to grinding stones) 16, feed screw devices (corresponding to a mobile unit) 18, and a driving cylinder (corresponding to a pressing unit) 20.

The glass funnel 12 has a yoke portion 13 supported by the yoke supporting ring 14 from outwardly, and the glass funnel is pressed against the grinding wheels by the yoke supporting ring 14, having a seal edge 12A thereof directed downward. The glass funnel 12 may be supported by the yoke supporting ring 14 and another supporting unit different from the yoke supporting ring 14.

The yoke supporting ring 14 is provided at a lower end of a rod 22 of the driving cylinder 20 so as to be rotatable with respect to the rod. By this arrangement, the driving cylinder 20 can transmit a pressing force (an elastic force) to the glass funnel 12 through the rod 22 and the yoke supporting ring 14. The rod 22 has a rectangular plate-shaped cover 24 provided so as to face downwardly. The cover 24 is the one that encircles the glass funnel 12 during grinding as shown by a chain-dotted line in FIG. 1. A working liquid that is supplied to the glass funnel 12 during grinding can be prevented from scattering by the cover 24.

The driving cylinder 20 is provided at a substantially central portion of a horizontal beam (corresponding to an elevating member) 26, the horizontal beam 26 has a through hole 27 formed therein, and the rod 22 is provided so as to pass through the through hole.

The horizontal beam 26 has both end portions fixed to upper portions of two feed rods (corresponding to a pole) 28, 28, each forms a part of each of the feed screw devices 18. The feed rods 28, 28 are provided in a vertical direction, and the feed rods have lower end portions guided by linear travel guides 30 and engaged therewith in non-rotatable fashion. The linear travel guides 30 are fixed to a table 34, which is provided on an installing plate 32.

Figure 2:
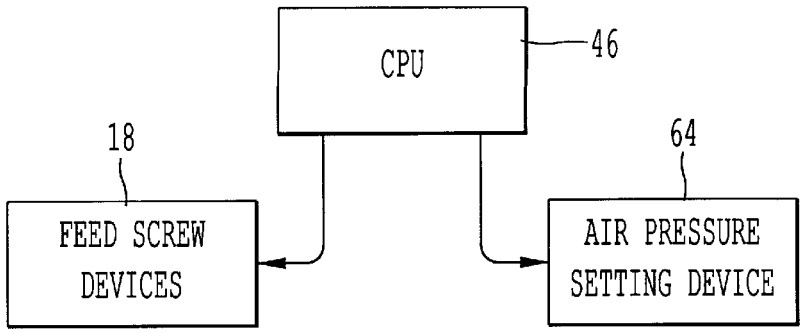
FIG. 2 is a block diagram showing the control by the grinding apparatus shown in FIG. 1.

The feed rods 28 are formed so as to have respective bores formed therein, the respective bores have inner peripheral surfaces 36 at lower portions formed with internal threads 38, and ball threads 40 are engaged with the internal threads 38. The ball threads 40 have respective lower ends coupled with the spindle 44 of electric motors 42. By this arrangement, when the spindles 44 are rotated by the electric motors 42, the rotational forces are transmitted from the electric motors to the ball threads 40 to vertically move the feed rods 28 by the rotational action of the ball threads 40 and the linear travel guiding action of the linear travel guides 30. As a result, the horizontal beam 26, which is coupled to the feed rods 28, can be vertically moved to move the yoke supporting ring 14 with respect to the grinding wheels 16 in the vertical direction. The vertical travel speed and the displacement of the horizontal beam 26 are numerically controlled by a CPU 46 shown in FIG. 2. As an example of the numerical control, there is a method that the electric motors 42 are provided with encoders and the numerical control is carried out, making use of information on the rotary angle of the spindles outputted from the encoders. Although the respective ball threads 40 are rotated by the respective electric motors 42 to vertically move the horizontal beam 26 in the shown apparatus, the ball threads 40 may be driven by a single electric motor.

On the other hand, the grinding wheels 16 shown in FIG. 1 are provided at, e.g., 3–6 locations so as to be equally spaced on a circle around a fixing supporter 48 (only two of the grinding wheels 16 are shown in FIG. 1). The grinding wheels 16 are coupled to the spindles 52 of electric motors 50 and are rotated by the electric motors 50. The electric motors 50 have lower ends coupled to the rods 56 of jacks (e.g., screw-cylinder devices) 54, which are fixed to the installing plate 32. By this arrangement, the rods 56 of the jacks 54 can be vertically moved to control the height of the grinding wheels 16. The fixing supporter 48 is a supporter that centers the glass funnel 12. The supporter is fixed to an upper end of the spindle 60 of a driving electric motor 58. The fixing supporter 48 is fixed to the spindle 60 through an elastic unit for instance. The supporter is positioned at a certain height by the elastic force of the elastic unit before the glass funnel 12 is carried on the supporter. When the glass funnel 12 is carried on the supporter 48, and when the glass funnel 12 has an inner peripheral surface contacted with an outer peripheral tapered surface of the supporter 48, the glass funnel 12 can have the positioning height and the posture thereof corrected along the outer peripheral tapered surface to be centered. Then, when the yoke supporting ring 14 lowers and contacts the yoke portion of the glass funnel 12, and when the yoke supporting ring further lowers, the fixing supporter 48 is downwardly moved by compression of the elastic unit. As a result, the glass funnel 12 is rotated by the driving motor 58 and carried on the grinding wheels 16, being sandwiched between the fixing supporter 48 and the yoke supporting ring 14. The positioning height of the supporter 48 at that time is determined by the yoke supporting ring 14, which is controlled in height through the feed screw devices 18 based on positioning information from the CPU 46. The CPU 46 activates an air pressure setting device (a regulator) 64 in response of the positioning height of the yoke supporting ring 14, that is to say, upon completion of the feed controlled grinding by the feed screw devices 18. The driving electric motor 58 is fixed to the table 34.

The air pressure setting device 64 is a device that controls the air pressure in the driving cylinder 20 shown in FIG. 1. The air pressure setting device 64 determines a pressing force to press the seal edge 12A of the glass funnel 12 against the grinding wheels 16 when finish machining, that is, pressure controlled grinding is carried out. The air pressure setting device 64 is connected to an air pump 66.

The operation of the seal edge grinding apparatus 10 thus constructed will be explained.

First, the glass funnel 12 is carried on the fixing supporter 48 so as to have the yoke portion 13 supported by the supporter 48 from inside with the seal edge 12A of the glass funnel 12 directed downwardly. At that time, the seal edge 12A is located at a slightly higher position than the grinding wheels 16 since the glass funnel is elastically supported by the fixing supporter.

Figure 3:
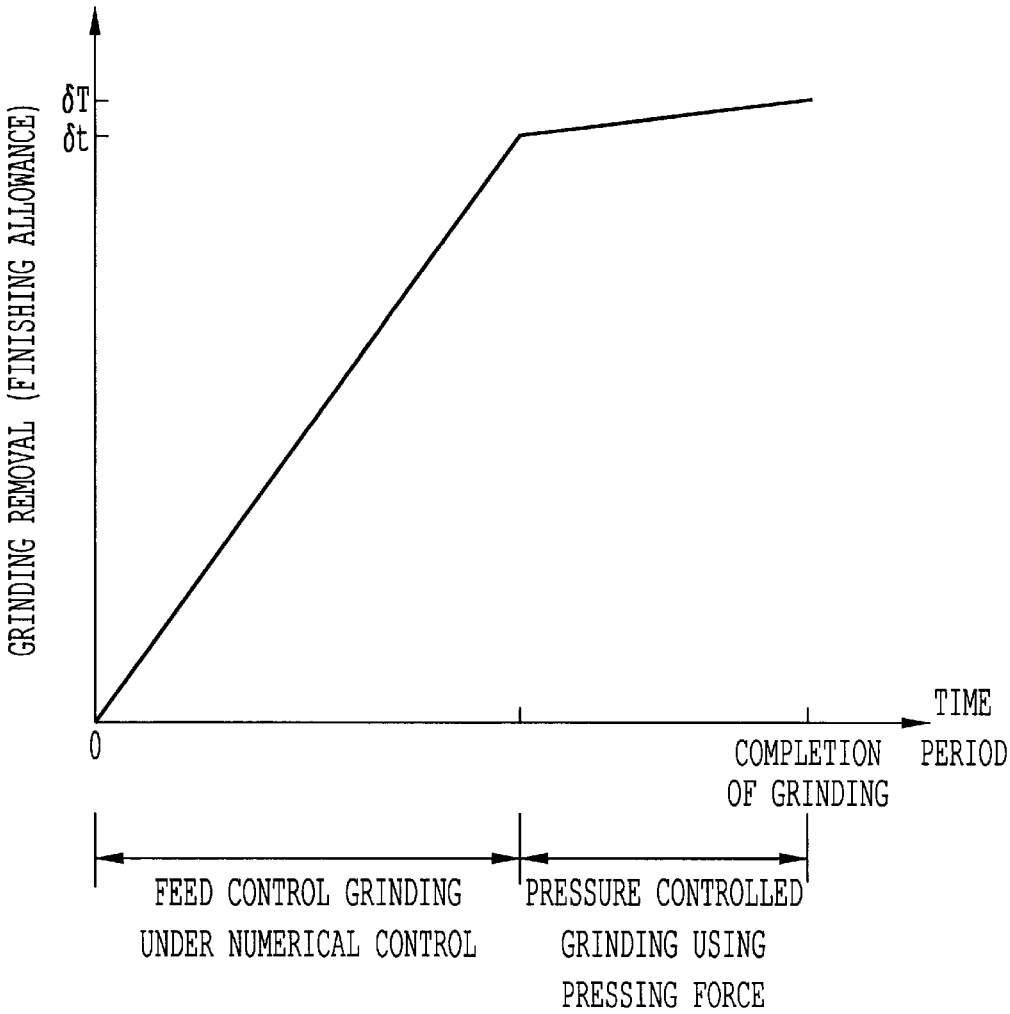
FIG. 3 is a graph explaining grinding removal with respect to grinding time periods.

Next, the electric motors 42 of the feed screw devices 18 are driven to lower the horizontal beam 26, vertically moving the yoke supporting ring 14. The yoke supporting ring 14 have an inner peripheral surface contacted an outer surface of the yoke portion of the glass funnel 12 to fixedly hold the glass funnel 12 with the glass funnel centered. When the yoke supporting ring 14 is further lowered in a state, the fixing supporter 48 is lowered against the elastic force, and the glass funnel 12 is pressed against the grinding wheels 16, being sandwiched between the supporter 48 and the yoke supporting ring 14. Since the grinding wheels 16 are rotated by the electric motors 50 at that time, the seal edge 12A of the glass funnel 12 starts to be subjected to the feed control grind at the same time that the seal edge is pressed against the grinding wheels. The yoke supporting ring 14 is further lowered during the feed controlled grinding to continuously grind the seal edge. The final vertical position of the yoke supporting ring 14 is determined by the CPU 46 based on a preset grinding quantity. The CPU 46 controls the air pressure setting device 64, depending on the vertical position of the yoke supporting ring 14. For example, if the total finishing allowance is $\delta T$, the CPU carries out such control that a large part $\delta t$ of the total finishing allowance is removed by the feed controlled grinding using the feed screw devices 18 and the remaining part ($\delta T-\delta t$) is removed by the pressure controlled grinding using the driving cylinder 20 as shown in FIG. 3. In other words, the CPU 46 controls the downward travel speed and the downward displacement of the glass funnel 12 of the feed screw devices 18. The downward travel speed is finely controlled since the CPU 46 carries out numerical control. Since the feed controlled grinding is rough grinding, it is preferable that the downward travel speed (grinding speed) is set to be as great as possible in an acceptable range so as to complete grinding in a short time period.

When the set finishing allowance t is removed by the feed controlled grinding, the feed screw devices 18 are stopped to complete the feed controlled grinding. Then, the pressing force to press the glass funnel 12 against the grinding wheels 16 is set to a certain pressure by the air pressure setting device 64, and the seal edge 12A is pressed against the grinding wheels, starting the pressure controlled grinding. The pressing force given by the air pressure setting device 64 is quite smaller than the pressing force during the feed controlled grinding. When the remaining finishing allowance ($\delta T-\delta t$) is removed by the pressure controlled grinding, the driving cylinder 20 is locked, completing the pressure controlled grinding. By these operations, the grinding of the seal edge 12A of the glass funnel 12 is completed.

When the grinding is completed, the feed screw devices 18 are reversely operated to raise the yoke supporting ring 14. When the glass funnel 12 is released from the yoke supporting ring, the glass funnel is lifted by the elastic unit of the fixing supporter 48 to have the seal edge 12A separated from the grinding wheels 16. After that, the glass funnel 12 is taken out.

As explained, the grinding apparatus 10 according to this embodiment can remove the large part $\delta t$ of the total finishing allowance $\delta T$ by the use of the feed controlled grinding at a high speed and remove the remaining part ($\delta T-\delta t$) as the remaining finish allowance by the use of the pressure controlled grinding to grind the seal edge 12A of the glass funnel 12 in better and more efficient fashion. Although explanation of this embodiment has been made with respect to the grinding apparatus 10 wherein the seal edge 12A is ground with the glass funnel 12 moved, the present invention is not limited to this mode. The grinding method according to the present invention is applicable to a grinding apparatus wherein the grinding wheels 16 are moved toward the glass funnel 12. Although explanation of this embodiment has been made with respect to the arrangement wherein the driving cylinder 20 is provided on the side of the yoke supporting ring 14 to press the seal edge 12A against the grinding wheels 16 by the driving cylinder 20 during the pressure controlled grinding, the present invention is not limited to this mode. An arrangement wherein the grinding wheels 16 are pressed against the seal edge 12A by a pressing unit, such as a hydraulic device, may be adopted.

Although the driving cylinder 20 is illustrated as the pressing unit in this embodiment, the present invention is not limited to this mode. Any unit that can press the seal edge 12A and the grinding wheels 16 at a constant pressure is acceptable. An example of such a unit is a spring that has a movable stroke and a counter force set to quite small values. Such a spring sticks to the yoke supporting ring 14 or the grinding wheels 16 and is prevented from generating a pressing force during the vertical movement of the yoke supporting ring or the grinding wheels. When the vertical movement is stopped, the spring becomes active and generates the pressing force.

Although explanation of this embodiment has been made with respect to the grinding apparatus to wherein the seal edge 12A of the glass funnel 12 is ground, the present invention is limited to this type of apparatus. The grinding method according to the present invention is applicable to a grinding apparatus that grinds the seal edge of a glass panel for a Cathode-ray tube, and a grinding apparatus to grind another workpiece.

Although the yoke supporting ring 14 is provided on the horizontal beam 26 movable vertical in this embodiment, the yoke supporting ring 14 may be provided on a travel unit, which can vertically move with respect to a fixed horizontal beam. As explained, the method and the apparatus for grinding the seal edge of a glass funnel according to the present invention can remove a large part of a finishing allowance by the use of the feed controlled grinding at a high speed in a short time period and remove the remaining finishing allowance by the use of the pressure controlled grinding with a small grinding pressure so as to grind the seal edge of a glass funnel in better and more efficient fashion.

Since the feed control grind is numerically controlled, the grinding speed and the grinding removal can be precisely controlled not only to decrease the finish machining removal by the use of the pressure controlled grinding but also improve the dimension accuracy of products. Since the finish grinding removal by the use of the pressure controlled grinding is decreased, the grinding pressure for the pressure controlled grinding can be minimized to prevent a defect, such as a chip, from occurring.

Since the supporting member is vertically moved through the pole, the mobile unit for the supporting member can be provided independently from the pole to reduce the weight load borne by the pole by the weight of the mobile unit, and there is no need to prepare the pole, the elevating member and other parts so sturdily to cope with the production requirements.

Obviously, numerous modifications and variations of the present invention are possible in light of the above teachings. It is therefore to be understood that within the scope of the appended claims, the invention may be practiced otherwise than as specifically described herein.

What is claimed is:

1. A seal edge grinding method for a glass funnel, wherein the glass funnel and a grinding wheel are pressed against each other, and a seal edge of the glass funnel is ground with the grinding wheel, said method comprising the method steps of:

moving the glass funnel and the grinding wheel by a certain distance in a direction approaching each other via a mobile unit which is numerically controlled to grind the seal edge of the glass funnel using the grinding wheel to perform a feed controlled grinding operation; and relatively pressing the seal edge and the grinding wheel at a certain pressure via a pressing force from a pressing unit to grind the seal edge of the glass funnel with the grinding wheel to perform a pressure controlled grinding operation, after completion of the feed controlled grinding operation.

2. A seal edge grinding apparatus for a glass funnel, wherein the glass funnel has a seal edge to be ground, said apparatus comprising:

a supporting member for supporting the glass funnel at a yoke portion thereof;

a grinding wheel for grinding the seal edge of the glass funnel;

a mobile unit for moving said supporting member and said grinding wheel in a direction approaching each other by a certain vertical displacement;

a controller for numerically controlling said vertical displacement of said supporting member and said grinding wheel by said mobile unit; and a pressing unit for pressing at least one of said supporting member and said grinding wheel at a certain pressure by a pressing force;

wherein the seal edge of the glass funnel is ground by performing a pressure controlled grinding operation of said pressing unit, after the seal edge of the glass funnel has been ground with said grinding wheel by performing a feed controlled grinding operation, said feed controlled grinding operation being numerically controlled.

3. A seal edge grinding apparatus for a glass funnel, wherein the glass funnel has a seal edge to be ground, said apparatus comprising:

a grinding wheel;

a supporting member for supporting the glass funnel from above the glass funnel and for pressing the seal edge of the glass funnel against said grinding wheel, wherein the seal edge of the glass funnel is directed downwardly and said grinding wheel is located under said supporting member;

an elevating member for vertically moving said supporting member;

a pressing unit for pressing said supporting member toward said grinding wheel at a certain pressure;

a mobile unit for moving said supporting member by a certain vertical displacement with respect to said grinding wheel; and a controller for numerically controlling said vertical displacement of said supporting member via said mobile unit.

4. The apparatus according to claim 3, wherein said supporting member is mounted on said elevating member extending between two poles, said mobile unit for said supporting member includes a spindle engaged with one of said two poles and an electric motor for rotating said spindle, and said electric motor is numerically controlled by said controller to vertically move said supporting member by said certain vertical displacement toward said grinding wheel.

* * * * *